United States Patent [19]

Mutschler

[11] 4,355,726

[45] Oct. 26, 1982

[54] STAND FOR HOLDING AND SEALINGLY RETAINING INDIA INK DRAWING IMPLEMENTS

[76] Inventor: Otto Mutschler, Ludolf-Krehl-Str. 21, Heidelberg, Fed. Rep. of Germany, D-6900

[21] Appl. No.: 181,947

[22] Filed: Aug. 27, 1980

[30] Foreign Application Priority Data

Mar. 21, 1980 [DE] Fed. Rep. of Germany ..... 3010862

[51] Int. Cl.[3] ..... A47F 7/00

[52] U.S. Cl. ..... 211/69.5

[58] Field of Search ..... 211/69.1, 69.5, 69.2; 15/435

[56] References Cited

U.S. PATENT DOCUMENTS

| | | | |
|---|---|---|---|
| 1,804,120 | 5/1931 | Sengbusch | 211/69.5 |
| 2,650,570 | 9/1953 | Voelcker | 211/69.5 |
| 3,176,662 | 4/1965 | Williams . | |

FOREIGN PATENT DOCUMENTS

| | | |
|---|---|---|
| 1797582 | 10/1959 | Fed. Rep. of Germany . |
| 1800631 | 11/1959 | Fed. Rep. of Germany . |
| 1902405 | 10/1964 | Fed. Rep. of Germany . |
| 7016831 | 8/1970 | Fed. Rep. of Germany . |
| 1915566 | 10/1970 | Fed. Rep. of Germany . |
| 2108898 | 5/1972 | France . |

*Primary Examiner*—Roy D. Frazier
*Assistant Examiner*—Robert W. Gibson, Jr.
*Attorney, Agent, or Firm*—Kurt Kelman

[57] ABSTRACT

A stand for holding and sealingly retaining a plurality of India ink drawing implements includes a like plurality of sleeves for holding the drawing implements and for sealingly retaining the implements to prevent India ink therein from drying. Each implement comprises a tubular drawing point, a grip having a front end to which the point is attached and an annular bid of the grip rearwardly of the front end. A tubular packing in each sleeve surrounds the drawing point and has an annular sealing lip at an end thereof remote from the drawing point. A packing insert in the interior of the packing has a plane face adjacent the drawing point. A tubular clamping element in each sleeve surrounds the grip adjacent the packing and has an inwardly projecting cam. A first spring biases the packing insert to press the plane face thereof against the drawing point and a second spring biases the annular sealing lip into contact with the front end of the grip while engaging the annular bead of the grip with the cam whereby the drawing implement is doubly sealed and retained.

8 Claims, 4 Drawing Figures

STAND FOR HOLDING AND SEALINGLY RETAINING INDIA INK DRAWING IMPLEMENTS

The present invention relates to a stand for holding and sealingly retaining a plurality of India ink drawing implements which comprise a tubular drawing point, a grip having a front end to which the tubular drawing implement is attached and an annular bead rearwardly of the front end.

India ink drawing implements are usually provided with a screw cap placed over the drawing point to prevent the India ink therein from drying out. However, during drawing, it is often necessary alternately to use implements with tubular drawing points of different gauges. To make certain each implement functions properly, it is required to place the closing cap over the drawing point after each use of the implement. This is quite time-consuming and it has, therefore, been proposed to provide a stand wherein a plurality of such drawing implements may be held for alternate use. However, none of the stands heretofore provided dependably seal the drawing points of the implements held and retained therein so that they are not fully protected from drying out.

German utility model No. 1,902,405 discloses a two-part box for holding India ink drawing implements. The upper part of the box is open on top and closed at the bottom and has recesses shaped to receive the implements while its lower part provides a support for one or more capped implements.

U.S. Pat. No. 3,176,662 discloses an illustrator's penholder desk set comprising a plurality of individual tubular wells for holding the pens and sponges at the bottoms of the wells. The sponges are saturated with water to maintain a moist atmosphere in the wells to prevent drying of the ink in the pen points during the time the pens are supported in the wells. However, if soaking of the sponges with water is neglected or the set is used for a length of time causing the sponges to dry out, the tubular pen points will not be kept wet. Thus, maintenance of the desk stand for effectively preventing the drying of the pen points is cumbersome and is not really dependable.

German utility model No. 1,800,631 discloses a storage container for tubular India ink filled pens. The sealed container contains a liquid and has an insert for the vertical holding of the pens. This provides no seal preventing drying of the ink in India ink drawing implement temporarily out of use.

French patent publication No. 2,108,898 describes a protective cap for a tubular writing implement. The cap has a bore with a packing and a packing insert so cooperating with the implement inserted therein that the writing point is sealed by the packing insert and the front end of the grip is sealed by the packing.

German utility model No. 7,016,831 discloses a stand for tubular writing implements whose wells for receiving the implements are pivotal.

Published German patent application No. 1,915,566 discloses a cap for a writing implement to keep its point wet, the interior walls of the cap screwed onto the implement surrounding the point on all sides with a minimal distance, one of the inner walls of the cap engaging a supporting element for the point so that the air surrounding the point is sealed off.

German utility model No. 1,797,582 discloses a cap for an India ink pen, the cap having a part containing an elastic insert for sealing the pen point.

None of these devices provide a dependable long-term seal for India ink drawing implements stored in a stand for ready use without requiring maintenance, such as refilling with water, and this includes not only the stands but also the protective caps of the devices known to me.

It is the primary object of this invention to provide a stand for holding a plurality of India ink drawing implements so that they are securely retained therein and sealed off against any possibility of drying out, without the need for cumbersome maintenance, such as filling the holders with water from time to time, and expensive structural requirements.

The above and other objects are accomplished according to the invention with a stand which includes a plurality of sleeves for holding the drawing implements and for sealingly retaining the implements to prevent India ink therein from drying. A tubular packing in each sleeve surrounds the drawing point and has an annular sealing lip at an end thereof remote from the drawing point. A packing insert in the interior of the tubular packing has a plane face adjacent the drawing point. A tubular clamping element is inserted in each sleeve and surrounds the grip, the clamping element being adjacent the packing and having inwardly projecting camming means. A first spring means biases the packing insert to press the plane face thereof against the drawing point and a second spring means biases the annular sealing lip of the tubular packing into contact with the front end of the grip while engaging the annular bead of the grip with the camming means whereby the drawing implement is doubly sealed and retained.

The above and other objects, advantages and features of the present invention will become more apparent from the following detailed description of a now preferred embodiment thereof, taken in conjunction with the accompanying drawing wherein FIG. 1 is a fragmentary view of the stand, showing one sleeve in axial cross section, with a drawing implement inserted therein;

Figure 1:
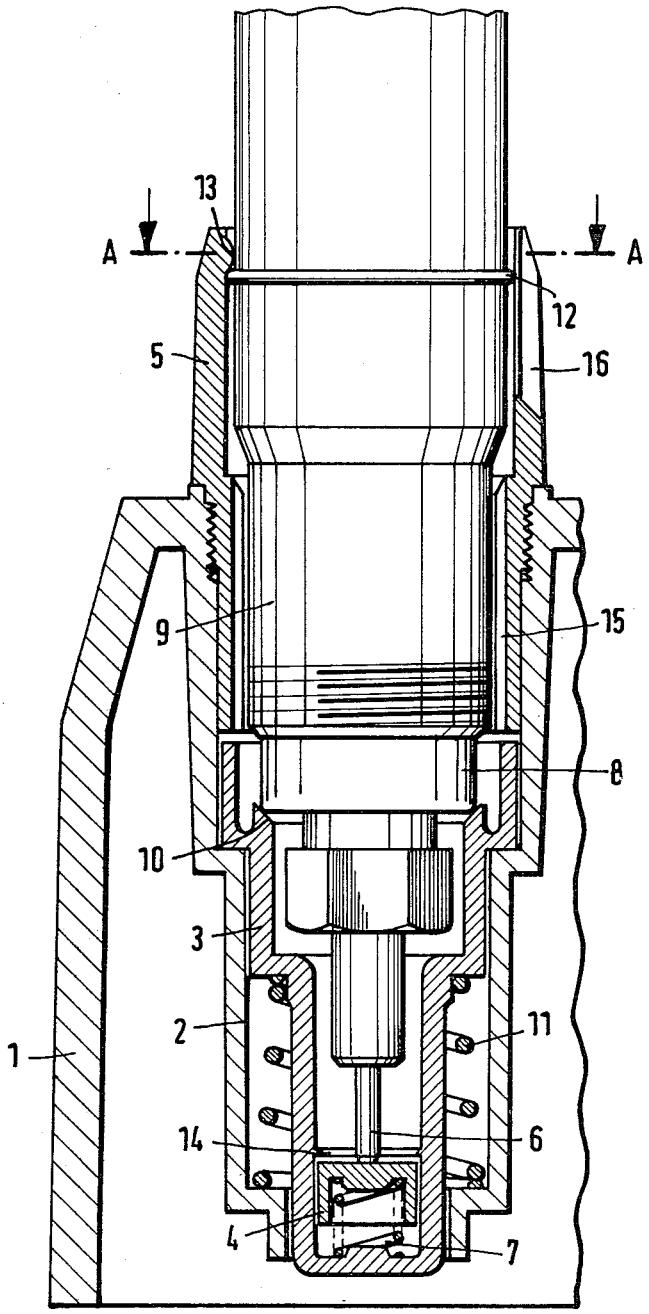
Figure 2:
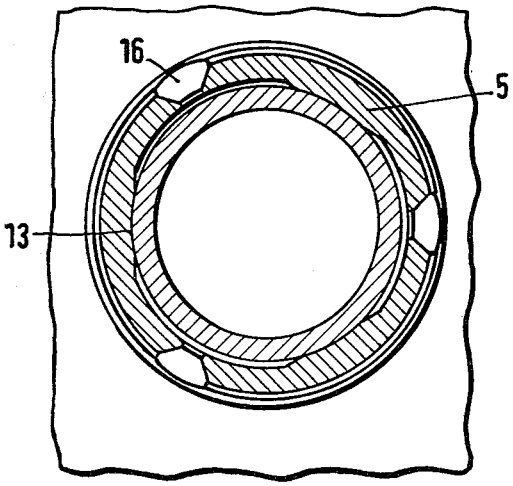
FIG. 2 is a transverse cross section along line A—A of FIG. 1.

Referring now to the drawing and first to FIGS. 1 and 2, there is shown a part of the stand for holding and sealingly retaining a plurality of India ink drawing implements in retaining base 1 which may be made of synthetic resin, metal or other suitable structural material. As shown in the drawing, each drawing implement comprises tubular drawing point 6, grip 9 having front end 8 to which the tubular drawing point is attached and annular bead 12 of the grip rearwardly of the front end. The stand includes a like plurality of sleeves 2 for holding the drawing implements and for sealingly retaining the implements to prevent India ink therein from drying. Tubular packing 3 in each sleeve 2 surrounds drawing point 6 and the tubular packing has annular sealing lip 10 at an end thereof remote from the drawing point, the sealing lip forming a frusto-conical seat for a conformingly shaped end of front end 8 of grip 9. Packing insert 4 having the shape of a hollow plug is arranged in the interior of tubular packing 3 and has a plane face adjacent drawing point 6. Tubular clamping element 5 is inserted in each sleeve 2 and surrounds grip 9 of the drawing implement. The clamping element is adjacent packing 3, being arranged coaxially therewith, and has inwardly projecting camming means 13. In the illustrated embodiment, the end of tubular packing 3 remote from sealing lip 10 is closed and a first spring means constituted in this embodiment by a coil spring is mounted between the closed end of the packing and packing insert 4, biasing the packing insert to press the plane face thereof against drawing point 6. A second spring means also constituted in the illustrated embodiment by a coil spring 11 biases annular sealing lip 10 of tubular packing 3 into contact with front end 8 of grip 9, coil spring 11 being shown mounted between a shoulder of sleeve 2 and a shoulder of tubular packing 3. Spring 11 also biases the grip of the drawing implement so that annular bead 12 of the grip engages camming means 13, this arrangement causing the drawing implement to be doubly sealed and retained. In this manner, the drawing implement is securely retained in the stand while its point is completely sealed to prevent drying of the ink therein whereby the implement is held in steady readiness for use.

According to a preferred feature, first spring means 7 has a bias of smaller force than that of second spring means 11 and annular bead 12 of grip 9 and camming means 13 of clamping element 5 cooperate so that the combined biasing forces of the first and second spring means against packing insert 4 and packing 3, respectively, securely seal drawing point 6 within the packing.

In accordance with another preferred feature, tubular packing 3 comprises inwardly projecting bead 14 limiting movement of packing insert 4 towards drawing point 6 under the bias of first spring means 7. Tubular packing 3 and coaxial tubular clamping element 5 have plane ends facing each other, contact between the plane ends limiting movement of the packing towards the clamping element under the bias of second spring means 11.

Tubular packing 3 and packing insert 4 are usefully made of elastic and vapor-impermeable material, such as a natural or synthetic rubber, to assure good sealing.

In the illustrated embodiment and according to a preferred feature of the invention, clamping element 5 defines a plurality of axially extending venting grooves 15 to prevent a vacuum effect on withdrawal of the drawing implement from sleeve 2 in which it is sealingly retained. Furthermore, tubular clamping element 5 is peripherally slotted at 16 (see also FIG. 2) to permit camming means 13 to engage annular bead 12 of grip 9 resiliently while allowing the implement to be withdrawn while bead 12 radially expands the clamping element as it passes over the camming means.

The drawing implement is inserted into sleeve 2 by pushing it into the sleeve until drawing point 6 contacts packing insert 4 and front end 8 of grip 9 engages sealing lip 10. In this position, the spring means act to provide full sealing contact between the drawing point and the packing insert as well as the sealing lip and the front end of the grip while simultaneously engaging annular bead 12 with camming means 13. In other words, a double seal is obtained, i.e. for drawing point 6 and for the front end of the grip while the drawing implement is securely retained in the sleeve by engaging bead 12 and camming means 13.

Figure 3:
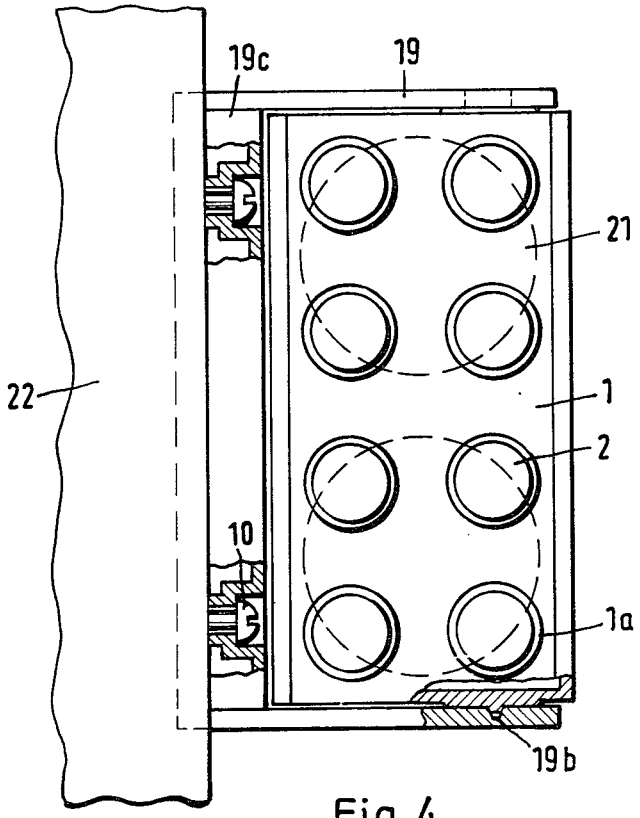
FIG. 3 is a top view of the stand, showing details in section.
Figure 4:
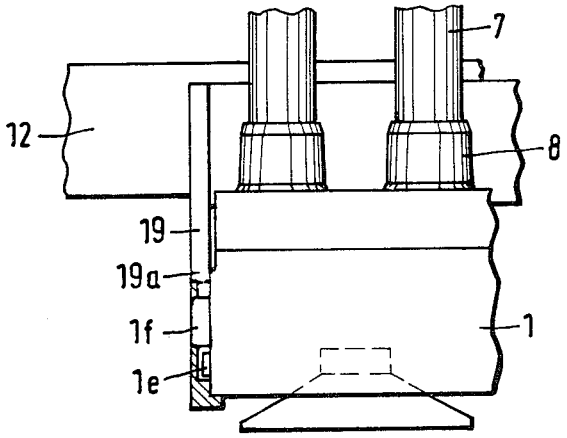
FIG. 4 is a fragmentary front elevational view of the stand held in a mounting frame, in an upright position, a detail being shown in section.

The present invention is not concerned with the specific structure of the stand and, merely for purposes of illustration and by way of example, this stand may take the form of the stand more fully described in my copending U.S. patent application Ser. No. 84,639, filed Oct. 15, 1979. As illustrated in FIGS. 3 and 4, a frame for mounting retaining base 1 is affixed to drawing board 22. The mounting frame is comprised of two side walls 19, 19 interconnected by ledge **19*c* and the frame ledge is affixed to a suitable portion of drawing board 22 by screws 20 inserted in bores in ledge 19*c*. Means is provided for pivoting retaining base 1 in relation to frame 19, 19*c* between a plurality of pivotal positions and for retaining the retaining base in each pivotal position. In the illustrated embodiment, the pivoting means comprises pivot pin or stud if projecting laterally from each side wall into bores 19*a* in adjacent side wall 19 of the mounting frame to provide a pivotal bearing for the retaining base in the frame. The illustrated retaining means for the retaining base comprises detent 1*e* projecting laterally from each side wall of retaining base 1 into a selected one of three grooves 19*b* in adjacent side wall 19 of the mounting frame to retain retaining base 1 selectively in three pivotal positions. Alternately, if it is desired to hold retaining base 1 securely on a surface, it may be supported by suction cups 21 attached to the bottom of the retaining base. In the illustrated embodiment, the retaining base has eight sleeves 2**.

I claim:

1. A stand for holding and sealingly retaining a plurality of India ink drawing implements each comprising a tubular drawing point, a grip having a front end to which the tubular drawing point is attached and an annular bead of the grip rearwardly of the front end, the stand including a like plurality of sleeves for holding the drawing implements and for sealingly retaining the implements to prevent India ink therein from drying, a tubular packing in each sleeve and surrounding the drawing point, the tubular packing having an annular sealing lip at an end thereof remote from the drawing point, a packing insert in the interior of the tubular packing has a plane face adjacent the drawing point, a tubular clamping element inserted in each sleeve and surrounding the grip, the clamping element being adjacent the packing and having inwardly projecting camming means, a first spring means biasing the packing insert to press the plane face thereof against the drawing point, and a second spring means biasing the annular sealing lip of the tubular packing into contact with the front end of the grip while engaging the annular bead of the grip with the camming means whereby the drawing implement is doubly sealed and retained.

2. The stand of claim 1, wherein the first spring means has a bias of smaller force than that of the second spring means.

3. The stand of claim 2, wherein the annular bead of the grip and the camming means of the clamping element cooperate so that the combined biasing forces of the first and second spring means against the packing insert and the packing, respectively, securely seal the drawing point within the packing.

4. The stand of claim 1, further comprising an inwardly projecting bead on the packing, the inwardly projecting bead limiting movement of the packing insert towards the drawing point under the bias of the first spring means.

5. The stand of claim 1, wherein the tubular packing and the tubular clamping element have plane ends facing each other, contact between the plane ends limiting movement of the packing towards the clamping element under the bias of the second spring means.

6. The stand of claim 1, wherein the tubular packing and the packing insert are of elastic and vapor-impermeable material.

7. The stand of claim 1, wherein the clamping element defines a plurality of venting grooves.

8. The stand of claim 1, wherein the tubular clamping element is peripherally slotted to permit the camming means to engage the annular bead of the grip resiliently.

* * * * *